US006685284B2

(12) United States Patent
Hara

(10) Patent No.: US 6,685,284 B2
(45) Date of Patent: Feb. 3, 2004

(54) UNLOCK SYSTEM OF PARTICULAR LOCKER

(75) Inventor: Kouichiro Hara, Tokyo (JP)

(73) Assignee: Kabushiki Kaisha Fulltime System, Tokyo (JP)

( * ) Notice: Subject to any disclaimer, the term of this patent is extended or adjusted under 35 U.S.C. 154(b) by 169 days.

(21) Appl. No.: 09/789,549

(22) Filed: Feb. 22, 2001

(65) Prior Publication Data

US 2001/0017507 A1 Aug. 30, 2001

(30) Foreign Application Priority Data

Feb. 28, 2000 (JP) ..... 2000-051456

(51) Int. Cl.[7] ..... E05B 65/46

(52) U.S. Cl. ..... 312/215; 700/241; 700/242; 340/5.73; 340/5.81

(58) Field of Search ..... 312/326, 327, 312/328, 329, 215, 237; 348/14.07; 340/5.8, 5.81, 5.73; 700/241, 242

(56) References Cited

U.S. PATENT DOCUMENTS

| | | | | | |
|---|---|---|---|---|---|
| 3,701,100 | A | * | 10/1972 | Yarbrough | 340/5.5 |
| 4,581,634 | A | * | 4/1986 | Williams | 348/156 |
| 4,836,352 | A | * | 6/1989 | Tateno et al. | 194/215 |
| 4,894,717 | A | | 1/1990 | Komei | |
| 5,126,732 | A | * | 6/1992 | Mardon | 340/5.73 |
| 5,172,970 | A | * | 12/1992 | Momose et al. | 312/329 |
| 5,212,644 | A | * | 5/1993 | Frisch | 235/378 |
| 5,219,386 | A | * | 6/1993 | Kletzmaier et al. | 70/277 |
| 5,223,829 | A | * | 6/1993 | Watabe | 700/215 |
| 5,231,272 | A | * | 7/1993 | Mardon | 340/5.73 |
| 5,385,265 | A | * | 1/1995 | Schlamp | 700/242 |
| 5,475,378 | A | * | 12/1995 | Kaarsoo et al. | 340/5.6 |
| 6,010,064 | A | * | 1/2000 | Umeda et al. | 235/375 |
| 6,314,169 | B1 | * | 11/2001 | Schelberg et al. | 700/231 |
| 6,323,782 | B1 | * | 11/2001 | Stephens et al. | 340/5.73 |
| 6,344,796 | B1 | * | 2/2002 | Ogilvie et al. | 340/5.73 |
| 6,539,360 | B1 | * | 3/2003 | Kadaba | 700/215 |
| 2002/0177922 | A1 | * | 11/2002 | Bloom | 700/213 |
| 2003/0050732 | A1 | * | 3/2003 | Rivalto | 700/237 |

FOREIGN PATENT DOCUMENTS

| | | | |
|---|---|---|---|
| JP | 05321531 | * | 12/1993 |
| JP | 9-330458 | | 12/1997 |

* cited by examiner

*Primary Examiner*—Lanna Mai
*Assistant Examiner*—Hanh V. Tran
(74) *Attorney, Agent, or Firm*—Armstrong, Kratz, Quintos, Hanson & Brooks, LLP

(57) ABSTRACT

When a legitimate recipient of a package or tenant loses a card issued to him or her for unlocking a particular locker of a locker cabinet, there is a problem that he or she cannot unlock the locker to open the same and pick up a package of merchandise deposited in the locker. An unlock system of a particular locker wherein a person who desires to unlock a particular locker makes contact with a control center to that effect through a communication line such that the control center authenticates personal identification of the person by calling said person at home, and the control center accesses a memory of the locker through the communication line to confirm that said locker is deposited with a package of merchandise therein and then, the control center unlocks the locker through the communication line.

2 Claims, 3 Drawing Sheets

UNLOCK SYSTEM OF PARTICULAR LOCKER

BACKGROUND OF THE INVENTION

The present invention relates to an unlock system of a particular locker of a locker cabinet disposed in an apartment or a tenant building, which unlock system is capable of authenticating personal identification without a card and unlocking the locker of said cabinet even if a recipient lost the card for unlocking the locker.

Usually, at an entrance of an apartment or a tenant building, there is disposed a cabinet having lockers for receiving packages sent by a delivery service, cleaned laundry sent by a cleaner, merchandise delivered from a catalog-using seller. A tenant who is supposed to be a recipient of a package of merchandise of the like has come to know by means of a delivery memo that a certain locker is used for receiving a package or the like for him or her uses a specified card for unlocking the said locker to open its door. Thus, the tenant can take out the delivered merchandise from the locker.

However, when the tenant loses the specified card for unlocking said locker, there is a problem that he or she cannot unlock the locker to open its door and take out the package of merchandise from the locker.

The present invention has been conceived of for solving the afore-mentioned problem, and it is an object of the invention to provide an unlock system of a particular locker of a locker cabinet in which even when a recipient loses his or her card for unlocking said particular locker, the control center of the system can authenticate personal identification of the intended recipient including his or her family to unlock the locker on his or her behalf such that the intended recipient can safely receive the package of merchandise.

SUMMARY OF THE INVENTION

The present invention provides an unlock system of a particular locker of a locker cabinet wherein a recipient who desires to unlock a particular locker communicates with a control center to that effect through a communication line, said control center authenticates personal identification of said recipient by calling him at home, said control center accesses a memory of said locker through the communication line and confirms that a particular locker is used for said recipient, and then, said control center unlocks said lock of said particular locker through the communication line.

It is possible to alter the sequence of the procedure that the control center authenticates personal identification of the person and the procedure that the control center accesses a memory in the cabinet through the communication line to confirm that a certain locker received a package or the like for the recipient.

DESCRIPTION OF EMBODIMENTS

Figure 1:
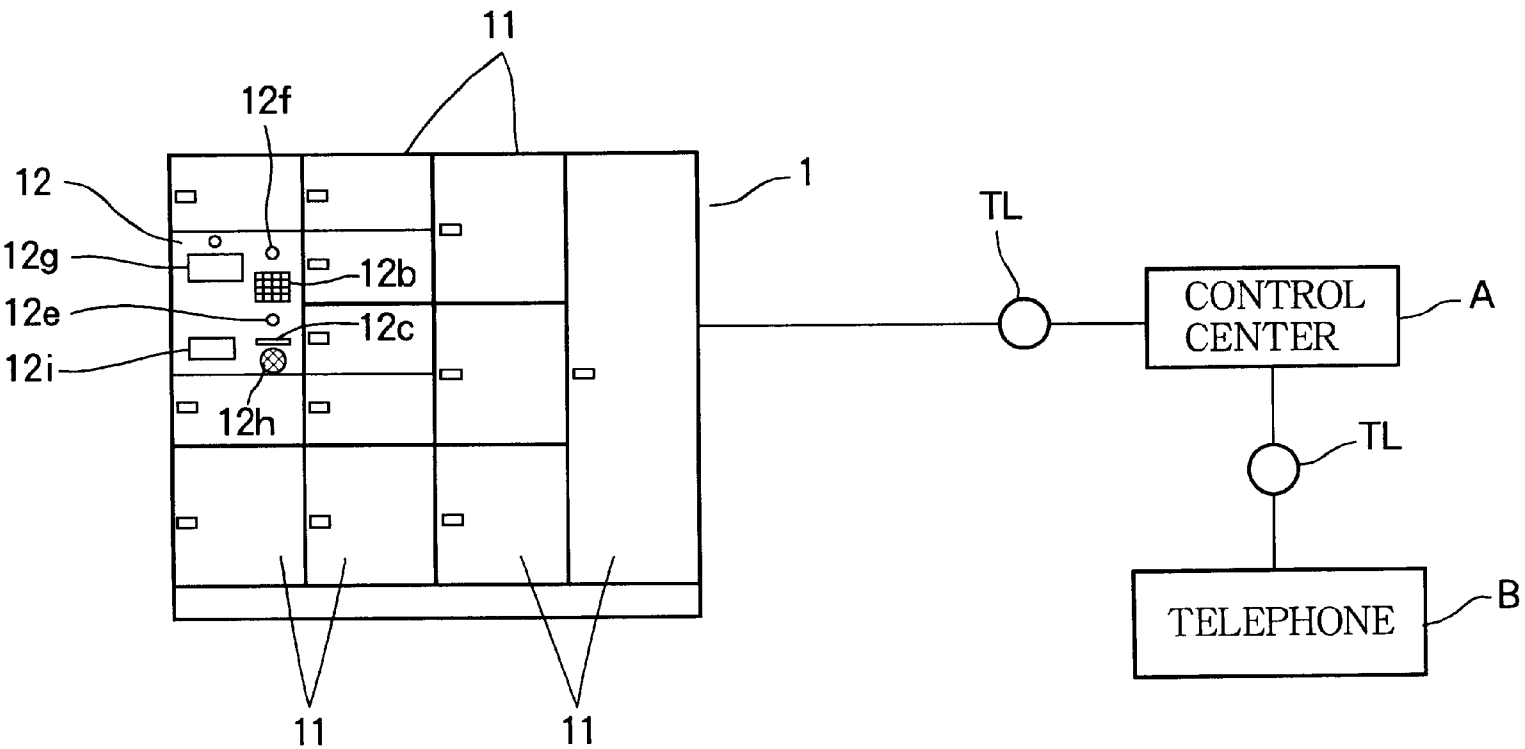
FIG. 1 is a schematic view showing an embodiment of an unlock system for a particular locker of a locker cabinet in accordance with the present invention.

A mode for embodying the invention of an unlock system for a particular locker of a locker cabinet will be explained with reference to the drawings. FIG. 1 shows the entire structure of the unlock system. A reference number 1 represents a locker cabinet disposed at an entrance of an apartment or a tenant building. As disclosed in Japanese Patent Application Laid-open No.9-330458 filed by the present applicant for example, when a tenant who is a recipient of a package of merchandise is absent, a dealer or the like deposits said package of merchandise in a locker 11 of a locker cabinet 1, and a delivery memo (receipt) noting a message that the package of merchandise for the tenant is deposited in a particular locker is dropped in said recipient's mailbox, and when the tenant or recipient returns and reads the delivery memo, he or she unlocks said particular locker of the locker cabinet to open its door and takes out the merchandise.

Figure 2:
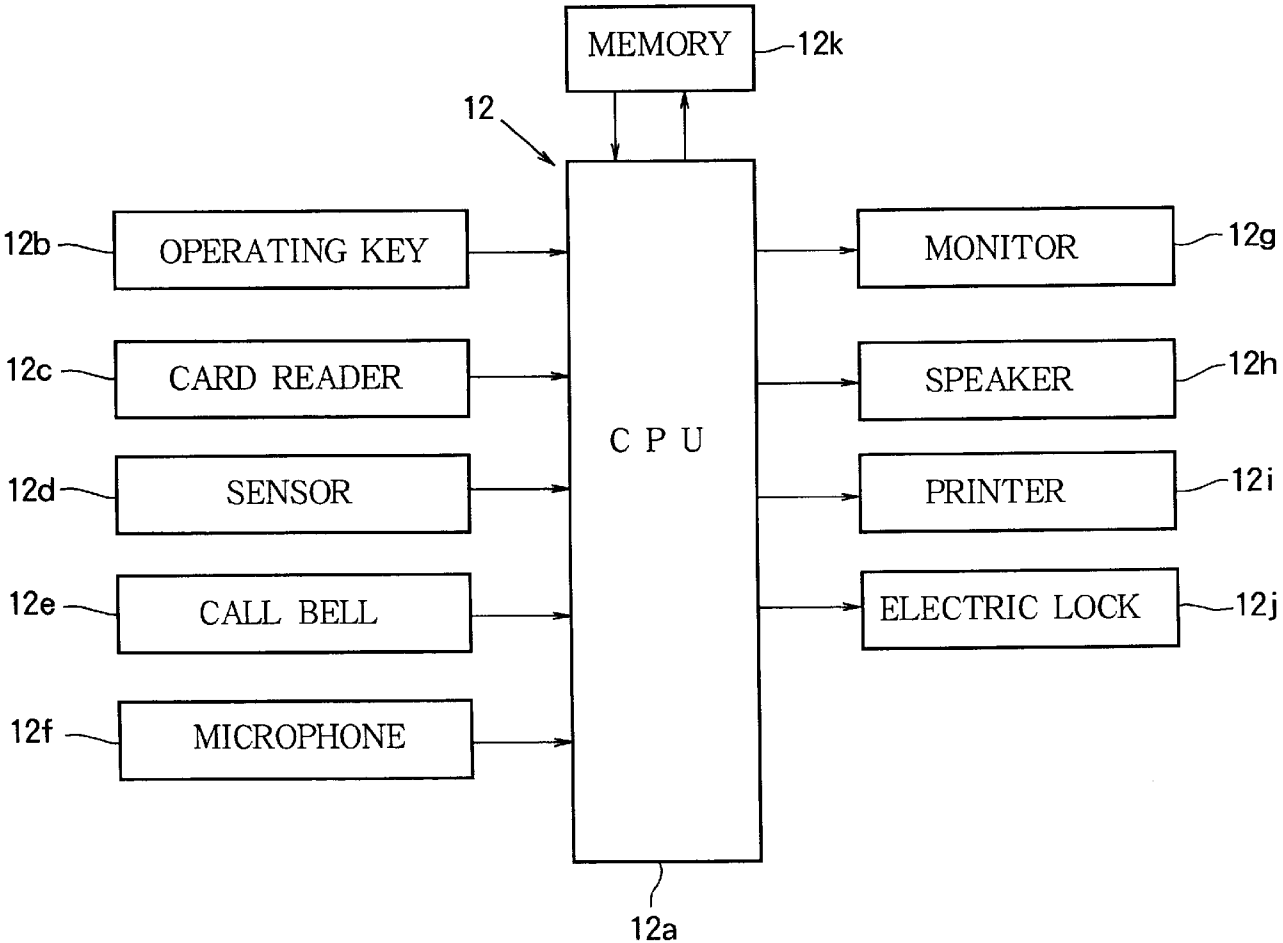
FIG. 2 is a circuit block diagram of a control box in the locker cabinet in accordance with the invention.

The locker cabinet 1 includes a plurality of lockers 11 of different size, and a control box 12 operated when the dealer or the like deposit a package of the merchandise to be delivered to a certain tenant and when the tenant takes out said package of merchandise therefrom. FIG. 2 shows the structure of the control box 12.

That is, the control box 12 comprises a central control unit 12*a*, operating keys 12*b* including ten keys, an escape key, a start key or the like; a card reader 12*c* for reading a card such as a credit card, an electronic card or the like; a sensor 12*d* for detecting a package of merchandise being deposited in the locker 11 and said package having been taken out, a call bell 12*e* for calling the control center, a microphone 12*f* for communicating with the control center, a monitor 12*g* for displaying the operation procedure or the like, a speaker 12*h* for communicating with the control center or giving an audio instruction of the operation procedure, a printer 12*i* for printing a message showing that a dealer deposited a package of merchandise to be delivered a certain tenant, an electric lock 12*j* for locking the locker 11, and a memory 12*k*. The operating keys 12*b* to the memory 12*k* are connected to the central control unit 12*a*.

The central control unit 12*a* is connected to the control center through a modem (not shown) such that the unit 12*a* can communicate with the locker cabinet 1 on the telephone and exchange data therebetween.

Returning to FIG. 1, a reference symbol TL represents a communication line such as a public telephone line or a private telephone line, a reference symbol A represents the control center of a control company connected to the locker cabinet 1 for controlling the same through the communication line TL, and a reference symbol B represents a personal telephone of a person utilizing the locker 1 cabinet connected to the control center A through the communication line TL.

Next, a method of depositing the package of merchandise in a locker 1 of the cabinet 1 based on the above-described structure will be explained. It is to be noted in this connection that cards for depositing a package of merchandise in the locker 1 are issued in advance to the dealers such as mail-order sellers, cleaners who deliver laundry in accordance with contract concluded between the control center A and the dealers or the like.

When depositing a package or the like, the dealer inserts the card issued to him into the card reader 12*c* of the control box 12 to allow the card to be read. Then, the central control unit 12*a* judges whether a card is inserted or not. If the central control unit 12*a* determines that a card is inserted, the unit 12*a* allows the dealer to input the recipient's room number.

Then, the dealer operates the operating keys 12*b* to input said room number. Here, the central control unit 12*a* judges whether said room number is an existing room number or not, and if the central control unit 12*a* determines that the room number really exits, the operating keys 12*b* for inputting the locker number is brought into the operable state and thus, the dealer or the like operates the operating keys 12*b* to input the number of the locker in which the dealer or the like deposits a package of merchandise or the like. Then, the central control unit 12*a* judges whether the locker number has been input or not, and if input, the electric lock 12*j* of the input locker number is operated to unlock and open the door, and the sensor 12*d* for detecting the presence or absence of the package of merchandise or the like starts operating.

In this state, if the dealer or the like deposits the package of merchandise or the like into the locker 11, the central control unit 12*a* monitors whether the package of merchandise or the like has been deposited or not, i.e., whether the sensor 12*d* detects the package of merchandise or not. If the central control unit 12*a* determines that the package of merchandise has been deposited, the central control unit 12*a* closes the door of the locker 11 while the electric lock 12*j* is returned (to the lock position) to lock the door. If the door of the locker is locked, the printer 12*i* is operated to issue a receipt and a delivery memo on which a name of the dealer, the room number, the date and a name of the dealer or the like are printed, thus completing the package depositing operation is completed.

The dealer receiving the delivery memo and the receipt drops the delivery memo into a mail box of the recipient's or tenant's room number whereas the dealer brings back the receipt, thus completing the delivery operation. And then, the content indicated in the receipt is stored in the memory 12*k* such that the control center A can access the memory 12*k*.

Next, a normal method for picking up the package of merchandise deposited in the locker 11 will be explained. It is to be noted in this connection that the card therefor has been issued in advance to the recipient or tenant in accordance with the control center A.

First, in order for the tenant or the like who has seen the delivery memo dropped in the recipient's mail post to pick up or take out the package of merchandise, said recipient or tenant or the like inserts his or her card into the card reader 12*c* to allow the card to be read. The central control unit 12*a* judges whether the card was inserted or not, and if the unit 12*a* determines that the card is a actually issued one, the electric lock 12*j* of the locker where the package of merchandise stored in the memory 12*k* is deposited is unlocked to open the door thereof.

When the sensor 12*d* confirms that the tenant has taken out the package of merchandise from the locker 11, said locker 11 is closed and at the same time, the electric lock 12*j* is returned (to lock position) to lock the door, thus completing the pick-up operation of the package of merchandise.

In the above embodiment, a card issued in advance is inserted into the card reader 12*c* so that the merchandise can be taken out but the package of merchandise may be taken out by inputting a previously registered personal identification number using the operating keys 12*b*, or the merchandise may be taken out by inputting both the card and the personal identification number.

Figure 3:
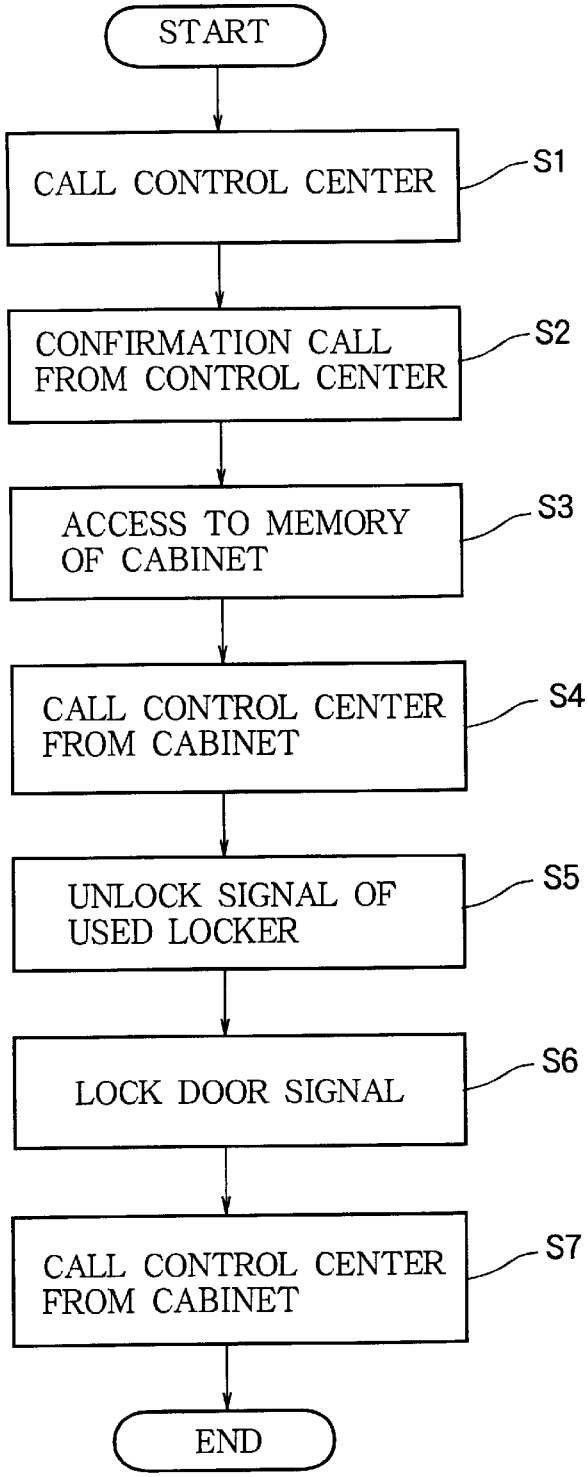
FIG. 3 is a flowchart showing the pick-up operation of a package of merchandise when a recipient loses his or her card.

Next, a method for taking out the package of merchandise in case where the recipient or tenant loses the card for picking up the package of merchandise deposited in the locker 11 will be explained with reference to FIG. 3.

First, in order for the tenant who has seen the delivery memo dropped in the mail post to successfully take out the package, he or she communicates with the control center A telephone to tell that he or she has lost his or her card and wishes to have the electric lock 12*j* of the locker 11 unlocked and gives the control center his or her password such as the room number (step S1). At that time, the control center A tells the tenant that he or she should go home and wait there for the control center call the tenant or his or her family at home since it is necessary for the control center to authenticate personal identification,.

The control center A having received the tenant's call from the locker cabinet confirms the tenant's telephone number based on the password, dials the telephone number to call the tenant at his or her room (step S2) and identify the original caller as the legitimate recipient. At that time, the control center gives the original caller an instruction move to the locker cabinet 1 such that the original caller calls the control center A again from the locker 1. During his or her move to the locker cabinet 1, the control center A accesses the memory 12 to confirm the locker 11 which is deposited with the package directed to the original caller (step S3).

When the original caller moves to the locker cabinet 1 and operates the call bell 12*e*, e.g., keeps pushing the call bell 12*e*, he or she can communicate with the control center A on the telephone, informs that he or she is now in front of the locker cabinet 1 (step S4), and releases the operation of the call bell 12*e* to finish the telephone call, the control center A sends the unlock signal for unlocking the electric lock 12*j* of the locker 11 which is deposited with the package directed to him or her (step S5), when the door is opened in the above-described manner.

When the sensor 12*d* confirms that the original caller has taken out the package of merchandise from the locker 11, the door of the locker 11 is closed and at the same time, the electric lock 12*j* is returned (to the lock position) to lock the door (step S6). Therefore, the original caller again operates the call bell 12*e* to inform the control center A that he or she received the package of merchandise, thus completing the pick-up operation (step S7).

In the method for taking out the package of merchandise in case where the would-be recipient loses the card, if an original caller could not be identified or when the control center A accessed the memory 12*k* of the locker cabinet 1 but there is no locker 11 being used, the subsequent procedure will be suspended.

Further, the sequence of the procedure that the control center authenticates personal identification of the person and the procedure that the control center accesses a memory of the locker through the communication line to confirm that the locker which is deposited with the package of merchandise directed to the person may be reversed for the package of merchandise to be taken out similarly.

As described above, according to the present invention, even if the card is lost, the lock of the locker being locked for the the user can be unlocked to open the door, and the user can swiftly pick up the package of merchandise from the locker.

What is claimed is:

1. An unlock system of a particular locker of a locker cabinet wherein a person who desires to unlock a particular locker communicates with a control center to that effect through a communication line, said control center authenticates personal identification of said person, said control center accesses a memory of said locker through the communication line and confirms that a particular locker is used for said person, and then, said control center unlocks said lock of said particular locker through the communication line.

2. An unlock system of a particular locker of a locker cabinet wherein a person who desires to unlock a particular locker communicates with a control center to that effect through a communication line, said control center accesses a memory of said locker through the communication line and confirms that a particular locker is used for said person, said control center authenticates personal identification of said person and then, said control center unlocks said locker through the communication line.

* * * * *